US005722661A

United States Patent [19]

Skratulia et al.

[11] Patent Number: 5,722,661

[45] Date of Patent: *Mar. 3, 1998

[54] METHOD OF PLAYING POKER

[75] Inventors: John Skratulia, Whittier; Fred Wolf, Chatsworth, both of Calif.

[73] Assignee: Fred Wolf and John Skratulia, Chatsworth, Calif.; A California general partnership

[ * ] Notice: The term of this patent shall not extend beyond the expiration date of Pat. No. 5,452,900.

[21] Appl. No.: 717,257

[22] Filed: Sep. 20, 1996

[51] Int. Cl.[6] ..... A63F 1/00

[52] U.S. Cl. ..... 273/292; 273/274

[58] Field of Search ..... 273/274, 309, 273/292

[56] References Cited

U.S. PATENT DOCUMENTS 5,452,900 9/1995 Skratulia et al. ..... 273/292

*Primary Examiner*—William M. Pierce

*Attorney, Agent, or Firm*—Timothy T. Tyson; Ted Masters

[57] ABSTRACT

An improved method 20 of playing the game of poker between which can be applied as an adjunct to virtually any of the numerous variations of the game. Each player places a wager 500 of the same amount. The conventional game is then played in accordance with the selected rules of play. After the conclusion of conventional play, an action player is selected. The action player compares hands with a first sequential player. The Winner of the comparison takes the wager 500 of the other player and then compares hands with the next sequential player. The Winner of that comparison takes the wager 500 of the other player and then compares hands with the next sequential player. This sequence continues until all players have participated.

15 Claims, 6 Drawing Sheets

TO SHEET 6 STEP 240

METHOD OF PLAYING POKER

DISCLOSURE OF INVENTION

The present invention is directed to an improved method of playing the game of poker. The method can be used as an adjunct to virtually any of the numerous varieties of the game. The improved method supplements conventional play with a round of sequential hand comparisons in which the better hand wins and then compares hands with the next sequential player. This wagering format allows players the chance to win, even though they did not win during conventional play. Further, it affords all players the opportunity of playing to the end of the game, even if they folded during conventional play.

In accordance with a preferred embodiment of the invention, each player places a wager of the same amount. An initial player, selected by lot or otherwise, and a first sequential player compare hands. The player having the better hand becomes the Winner and takes the wager of the other player. Then the Winner and the next sequential player compare hands. Again the player having the better hand becomes the Winner and takes the wager of the other player. This sequence is repeated until all players have participated.

In accordance with an important aspect of the invention, the improved method of play can be applied to any of the numerous variations of the game of poker. The improved method simply adds a series of sequential comparisons to the conventional game.

In accordance with an important feature of the invention the direction of sequential play may be either clockwise or counterclockwise.

In accordance with another important aspect of the invention, the initial player, sometimes referred to as the action player, is determined by rolling dice.

In accordance with a preferred embodiment of the invention, the wager of the same amount is in addition to other wagers which are a part of the conventional game of poker.

In accordance with another embodiment of the invention, the wagers of the players are not of the same amount, and the Winner takes an amount equal to the lesser wager of the two comparing players from the other player.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
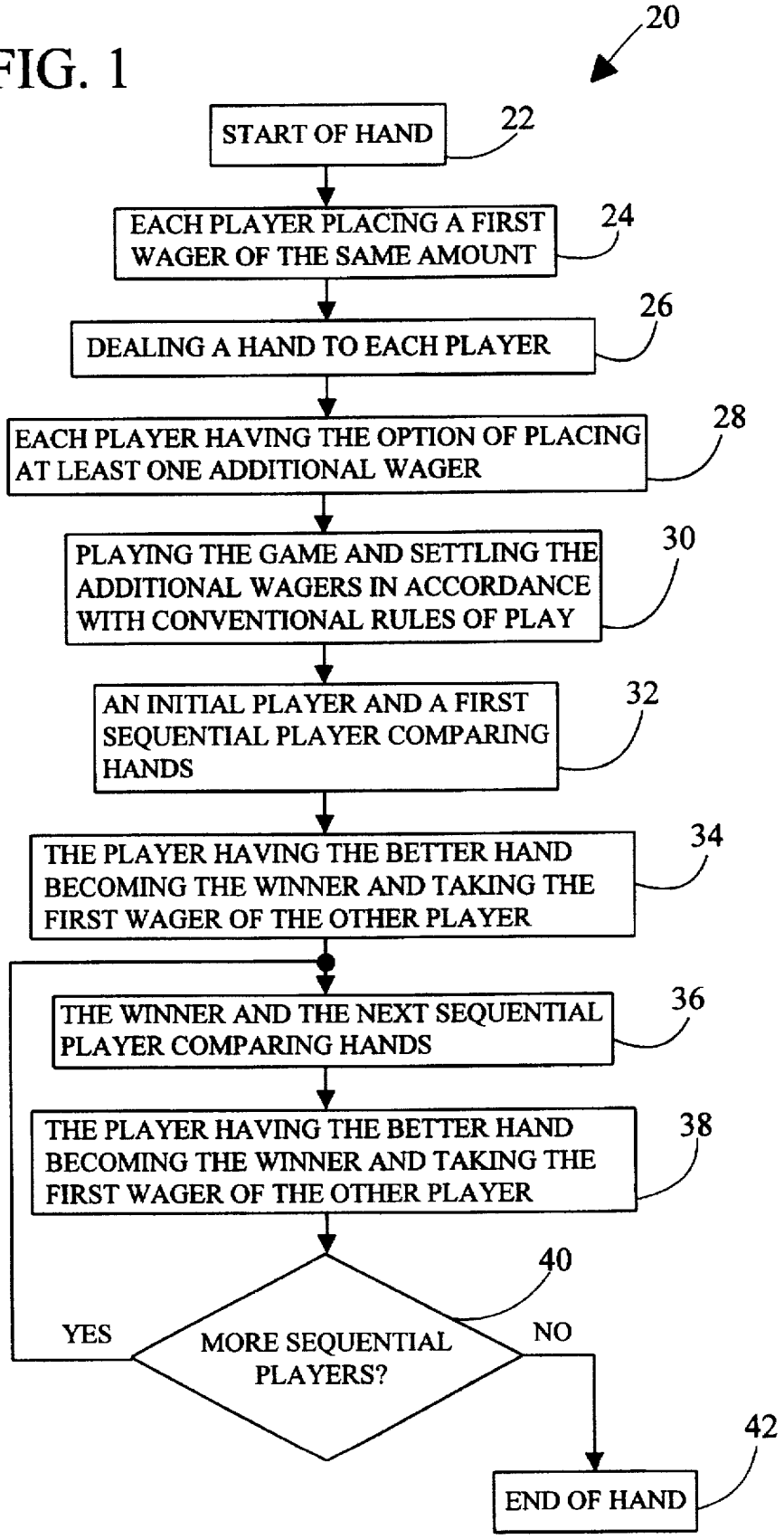
FIG. 1 is a flow diagram illustrating the steps and method of play of a game in accordance with the present invention.
Figure 3:
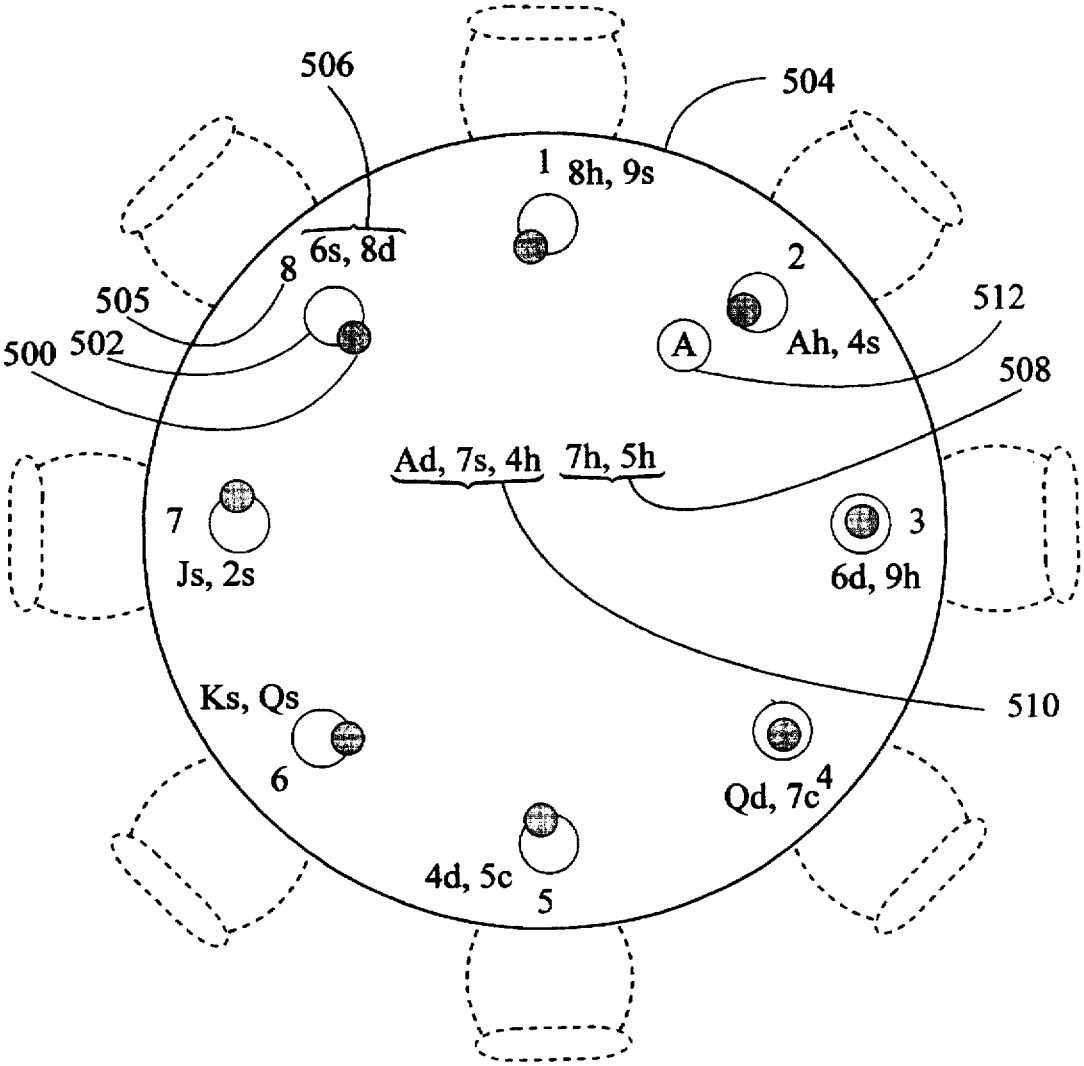
FIG. 3 is a plan view of a playing table layout.

Referring initially to FIG. 1 there is depicted a flow diagram illustrating the steps and method of play of an improved version of the game of poker in accordance with the present invention, generally designated as 20. FIG. 3 is a plan view of a playing table layout. The poker game includes a plurality of players, and is especially suited for play at a casino or other gaming establishment. The improved method disclosed herein can be utilized in conjunction with, and as an adjunct, to any one of the numerous variations of the game of poker such as draw, stud, high, low, five card, seven card, Hold'Em, Omaha, etc. In a preferred embodiment, the steps of the improved method disclosed herein are employed after the hand has been played according to the conventional rules of play. However, the improved method could also proceed conventional play.

A hand (round of play) begins with start terminator step 22. In step 24 each player of a plurality of players places a first wager 500 in betting areas 502 directly in front of them on playing table 504. First wager 500 could be in the form of an ante, but is preferably in the form of a separate wager in addition to the ante. In a preferred embodiment, each player places a first wager 500 of the same amount. However, in another embodiment, the first wagers 500 of the players are not of the same amount. In step 26 each player is dealt a hand. It is noted that the term "hand" has two connotations as used herein. The "hand" in step 22 (and step 26) relates to a complete round of play of the game of poker. The "hand" in step 26 relates to the specific cards which are dealt to each player. After seeing and evaluating the hand (cards), in step 28, each player has the option of placing an additional wager, or wagers if multiple rounds of betting are permitted. The additional wagers are made in accordance with the rules of the selected game of poker. For example, in draw poker a wager is typically made before the draw, and another wager after the draw. In stud poker, a wager is usually made after each round of up cards is dealt. A player may make a wager, raise a wager, or fold in accordance with the conventional rules of play. Or, in accordance with another possible embodiment of the present invention, the players would only make the first wager 500 of step 24, and not make any additional wagers in step 28. In this option, steps 28 and the settling portion of step 30 would be omitted.

The playing table 504 includes playing positions 505 for a plurality of players. Indicia depicting the betting areas 502, playing positions 505, or other pertinent information can be disposed upon the surface of the playing table 504 or a covering thereof.

In step 30 the game is played and the additional wagers are settled in accordance with the conventional rules of play of the particular poker game being played. It is noted that steps 22, 26, 28, 30, and 42 are a part of the conventional game of poker, and are not the subject of the present improved method. Step 24 could also be considered a part of the conventional game if the first wager is only an ante, and not an additional first wager 500.

In step 32, an initial player and a first sequential player compare hands. The initial player, sometimes referred to as the action player, is usually determined by rolling dice, however other random selection methods could also be utilized, or the action player could simply rotate around the table from hand (round) to hand. The first sequential player is preferably, but not mandatorily, adjacent to the initial player, and the sequential direction can be either clockwise or counterclockwise.

In step 34, the player having the better hand becomes the Winner and takes the first wager 500 of the other player. In a preferred embodiment, if the hands of the initial player and the first sequential player are equal (a tie), no first wager 500 is taken and the initial player becomes the Winner and continues play with the next sequential player. In step 36, the Winner in step 34 then compares hands with the next sequential player. In step 38 the player having the better hand becomes the Winner and takes the first wager of the other player. In a preferred embodiment, if the hands of the Winner and the next sequential player are equal, no first wager 500 is taken and the Winner continues play with the next sequential player. It is noted that for each comparison the title of Winner is given to player having the better hand, that player continuing play with the next sequential player. In other words, the title of Winner always passes to the player having the better hand. In step 40, it is determined if there are more sequential players. If YES, steps 36 and 38 are repeated until all players have participated. If NO, in step 42 the hand (round of play) is ended.

As can be seen from the above discussion, the improved method disclosed herein, specifically the first wager 500 in additional to an ante of step 24, and the sequential comparisons of steps 32 through 40, is an addition to the play of the conventional game. The conventional game is played as usual, and then the improved method is employed (or visa versa). One very important feature and advantage of the improved method is that it affords a player who did not win the conventional game a chance at winning a portion of the equal first wagers. That is, the second best hand can win something rather than losing everything to the best hand. Further, the improved method of the present invention permits all players to play to the end of the game.

In a variation of the method of FIG. 1, in step 24 the first wagers of the players are not of the same amount. And in steps 34 and 38 the player having the better hand becomes the Winner and takes an amount equal to the lesser first wager 500 of the two comparing players from the other player.

Figure 2A:
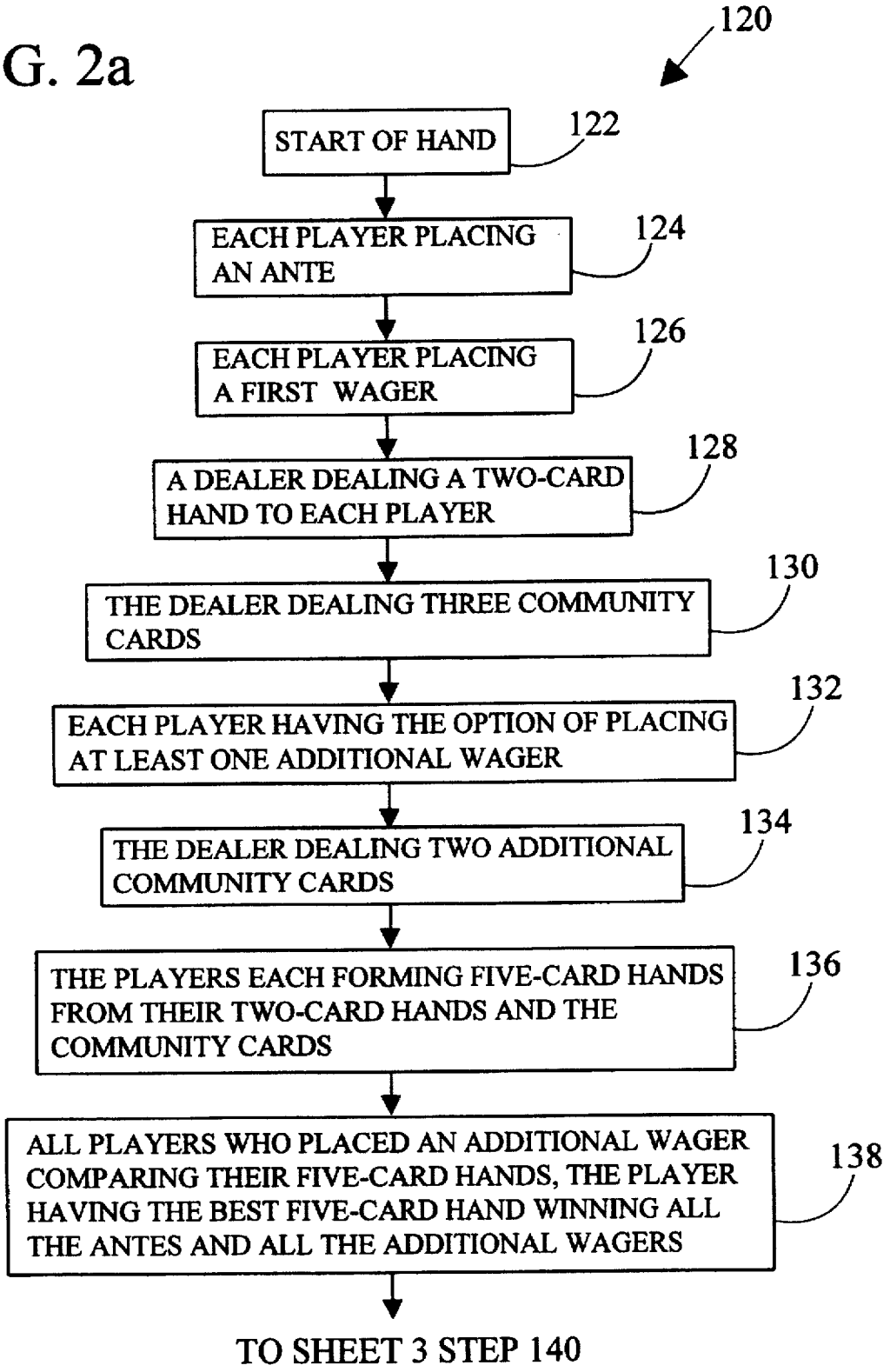
FIGS. 2*a* and 2*b* are a flow diagram of a second embodiment.
Figure 2B:
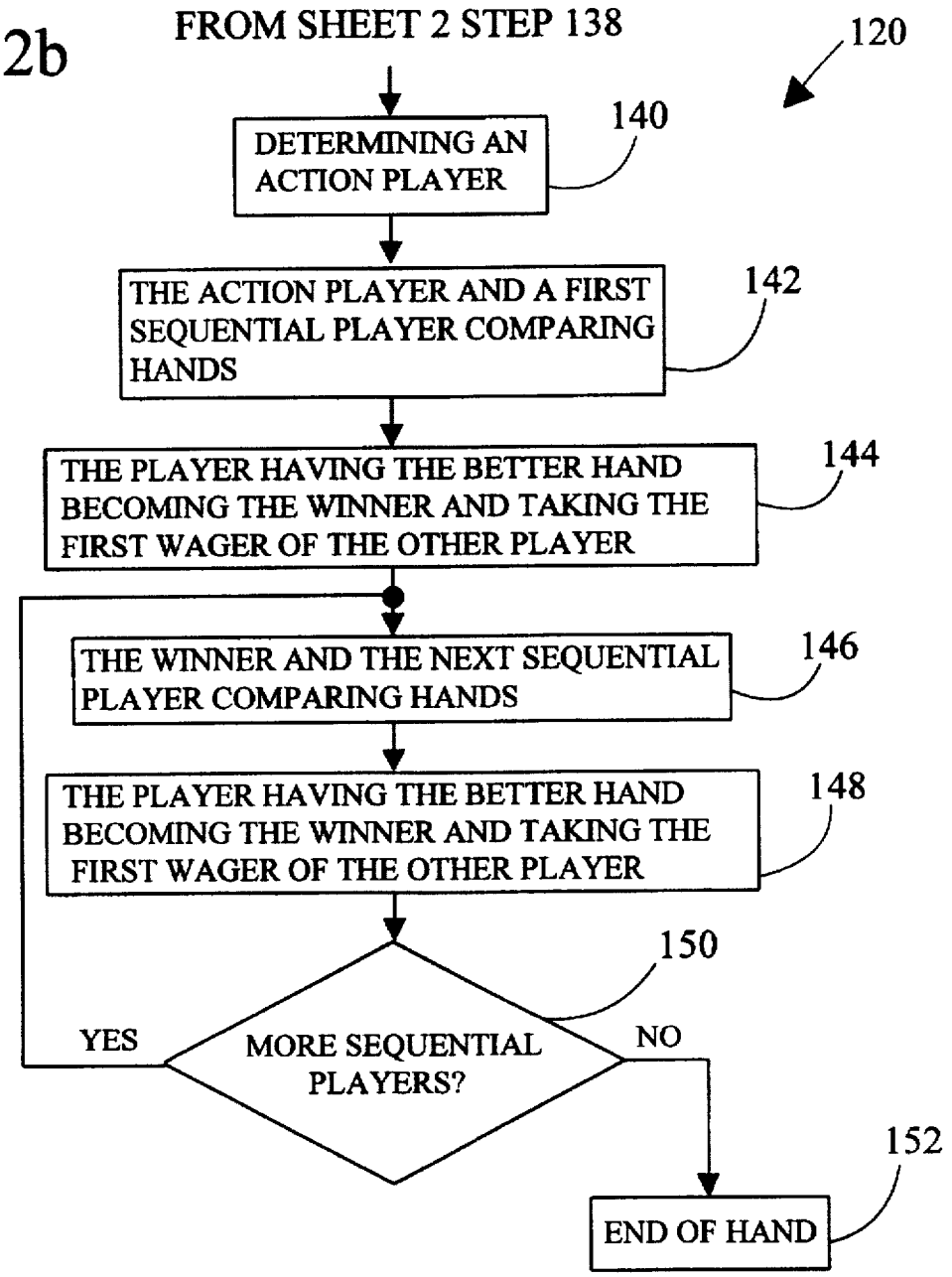

FIG. 2 is a flow diagram of a second embodiment, generally referred to as 120, and FIG. 3 is a plan view of a playing table layout. In this embodiment the improved method is used with the conventional game of Hold'Em Poker. A hand begins with start terminator step 122. In step 124 each player places an ante. In step 126 each player places a first wager 500. In a preferred embodiment each player places a first wager 500 of the same amount. In step 128 a dealer deals a two-card hand 506 face down to each player. In step 130 the dealer deals three community cards 508 face up on table 504. These cards may be used by any of the players. In step 132, after seeing and evaluating the hand, each player has the option of placing at least one additional wager. The additional wagers do not have to be of an equal amount. In step 134 the dealer deals two additional community cards 510 face up on the table. In a preferred embodiment the three community cards 508 are dealt face up at the same time, and the two community cards 510 are dealt face up one at a time. Additional wagers may also be made after each of the two community cards 510 is dealt. Of course, may other dealing and wagering options could also be used during the conventional portion of play.

In step 136 the players each form five-card hands from their two-card hands 506 and the community cards 508 and 510. Any five of the seven card may be used. In step 138 all players who placed an additional wager(s) compare their five-card hands, and the player having the best five-card hand in accordance with the rules of play wins all of the antes and all of the additional wagers. This concludes play of the conventional portion of the game. In step 140 an action player is determined by lot, usually by rolling dice. An action player marker or button 512 may be placed in front of the selected player. In the shown example player number 2 is the action player. In step 142 the action player and a first sequential player compare hands. In a preferred embodiment the first sequential player is the first clockwise player, or player number 3. In step 144 the player having the better hand becomes the Winner and takes the first wager 500 of the other player. In a preferred embodiment, if the hands of the action player and the first sequential player are equal, no first wager 500 is taken and the action player becomes the Winner and continues play with the next sequential player (e.g. player number 4). It is noted that the better hand may be the higher hand or the lower hand according to the chosen rules of play.

In step 146 the Winner in step 144 then compares hands with the next sequential player, player number 4. In step 148 the player having the better hand becomes the Winner and takes the first wager 500 of the other player. In a preferred embodiment, if the hands of the Winner and the next sequential player are equal, no first wager 500 is taken and the Winner continues play with the next sequential player (e.g. player number 5). It is noted that for each comparison the title of Winner passes to the player having the better hand. In step 150, it is determined if there are more sequential players. If YES, steps 146 and 148 are repeated until all players have participated. If NO, in step 152 the hand (round of play) is ended.

In the example shown in FIG. 3, the three community cards 508 are Ad, 7s, 4h, and the two additional community cards 510 are 7h, 5h. The two-card hands 506 are: (note that s=spades, h=hearts, d=diamonds, and c=clubs)

| Player No. | Two-Card Hand | Best Five-Card Hand | Ranking |
|---|---|---|---|
| 1 | 8h, 9s | Two 7's, A/9/8 | 7th |
| 2 | Ah, 4s | Two pair A's & 7's | 3rd |
| 3 | 6d, 9h | Two 7's, A/9/6 | 8th |
| 4 | Qd, 7c | Three sevens | 2nd |
| 5 | 4d, 5c | Two pair 7's & 5's | 4th |
| 6 | Ks, Qs | Two 7,s, A/K | 5th |
| 7 | Js, 2s | Two 7's, A/J | 6th |
| 8 | 6s, 8d | straight 8 high | 1st |

It is noted that to form the abovecited hands, the players use community cards. For example, player 1 uses the 7s, 4h, and 5h in addition to his/her 6s, 8d to form an 8 high straight. Similarly, player 4 uses the 7s with his/her 7h, 7c to form three sevens.

In FIG. 3 the conventional play has been completed and all additional wagers and antes removed from the table, only the first wagers 500 remaining. Player number 2 has been selected as the action player, the sequential direction is clockwise, and the high hand is the better hand. First player 2 compares hands with player 3. Player 2 has the better hand and takes the first wager 500 of player 3. The Winner, player 2, then compares hands with the next sequential player, player 4. Player 4 has the better hand and takes the first wager 500 of player 2. The Winner, player 4, then compares hands with the next sequential player, player 5. Player 4 has the better hand and takes the first wager 500 of player 5. The Winner, player 4, then compares hands with the next sequential player, player 6. Player 4 has the better hand and takes the first wager 500 of player 6. The Winner, player 4, then compares hands with the next sequential player, player 7. Player 4 has the better hand and takes the first wager 500 of player 7. The Winner, player 4, then compares hands with the next sequential player, player 8. Player 8 has the better hand and takes the first wager 500 of player 4. The Winner, player 8, then compares hands with the next sequential player, player 1. Player 8 has the better hand and takes the first wager 500 of player 1. Since there are no more sequential players, the hand (round of play) is then concluded.

It is noted that player 4, who would have lost to player 8 in the conventional portion of play, wins four first wagers 500 prior to losing to player 8 in the improved method portion. This removes some of the pain associated with being second best. In fact the third ranking player, player 2, wins one first wager 500. Of course, the determination of the action player and the direction of sequential play bare heavily upon the outcome of the improved method. For example, if the action player was player 7 or 8, and the direction was clockwise, player 8 would win all the first wagers 500.

Figure 4A:
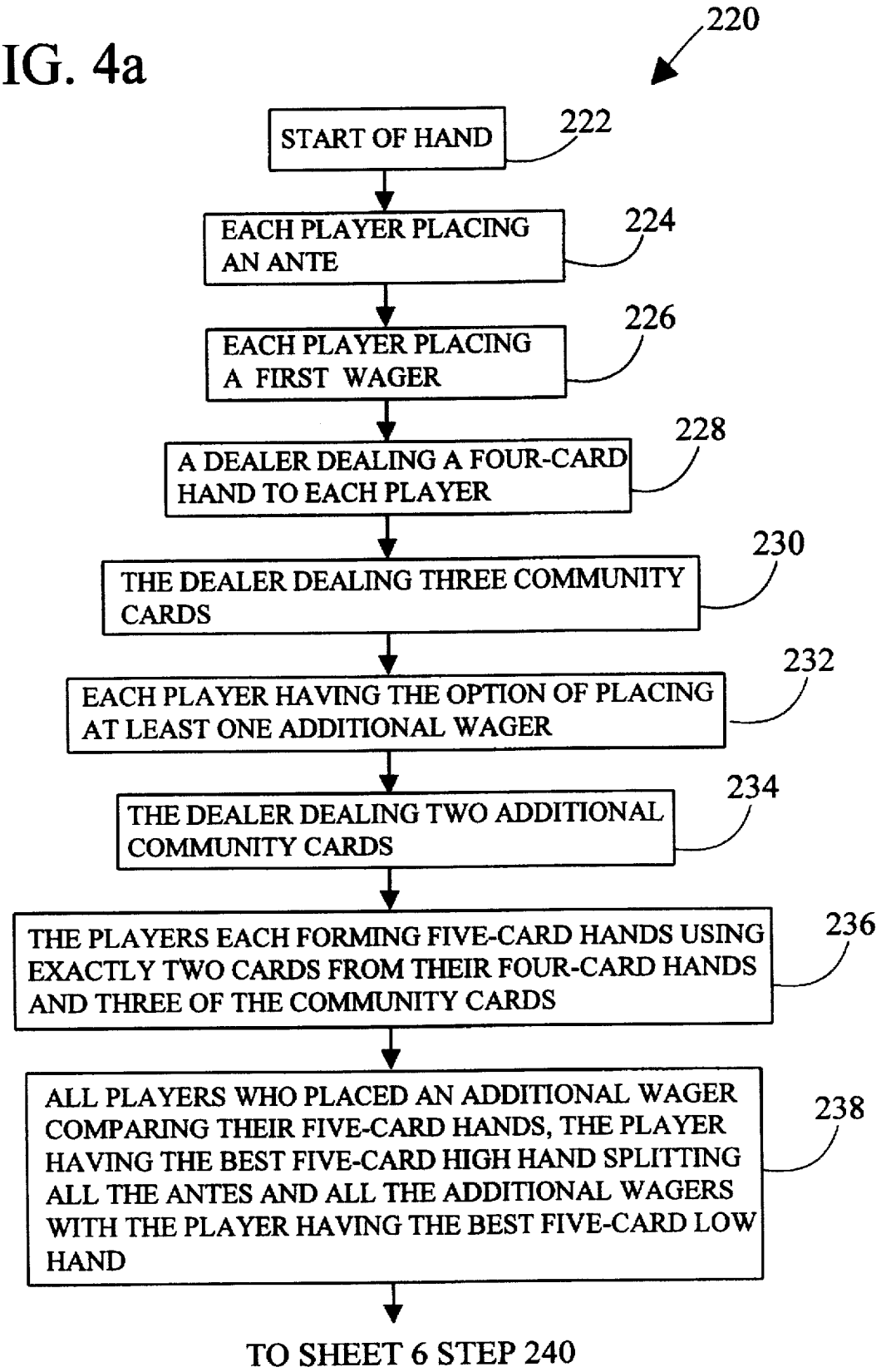
FIGS. 4*a* and 4*b* is a flow diagram of a third embodiment.
Figure 4B:
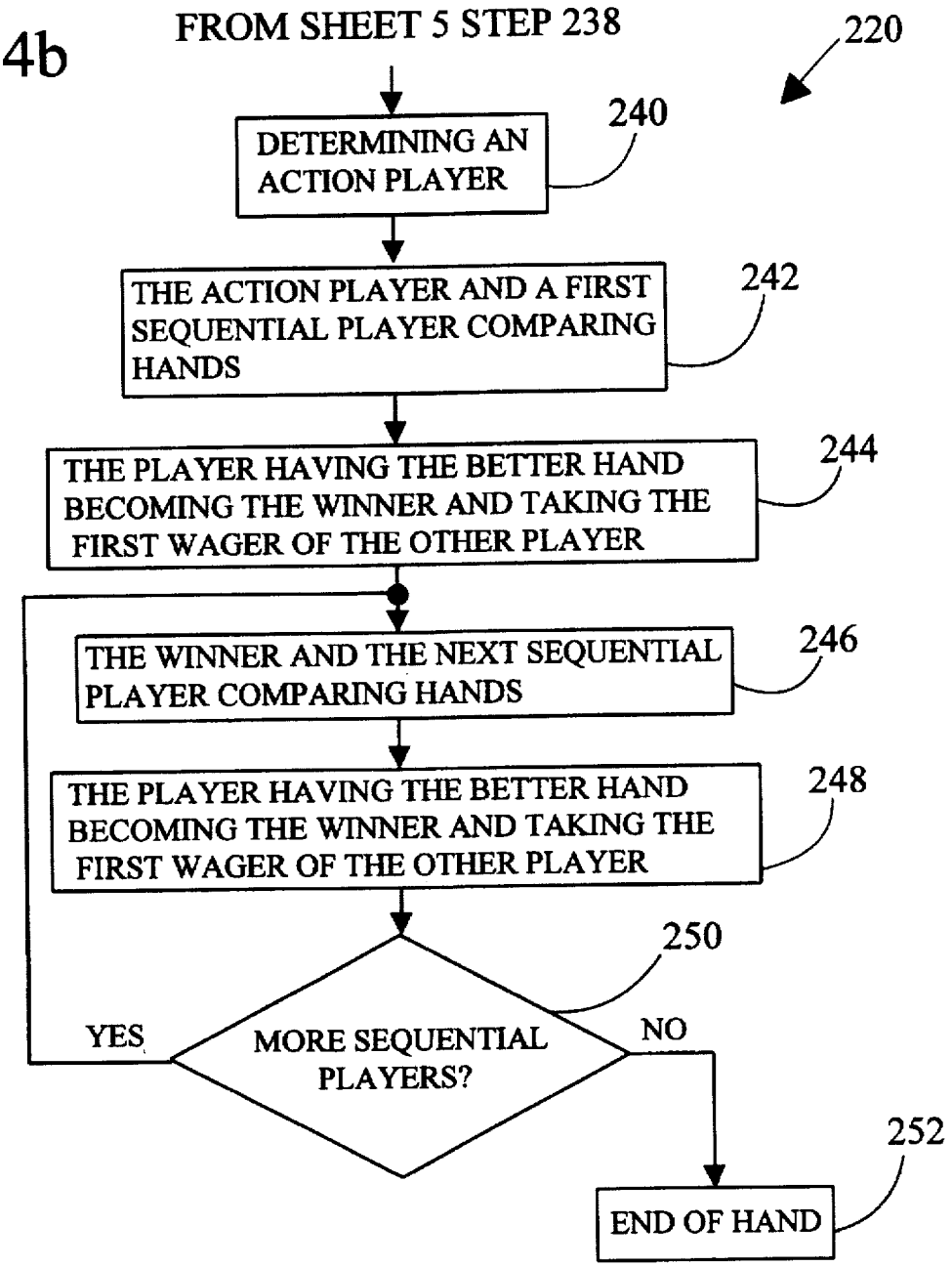

FIG. 4 is a flow diagram of a third embodiment, generally referred to as 220, and FIG. 3 is a plan view of a playing table layout. In this embodiment the improved method is used with the conventional game of Omaha Poker. A hand begins with start terminator step 222. In step 224 each player places an ante. In step 226 each player places a first wager 500. In step 228 a dealer deals a four-card hand face down to each player. In step 230 the dealer deals three community cards 508 face up on table 504. These cards may be used by any of the players. In step 232, after seeing and evaluating the hand, each player has the option of placing at least one additional wager. The additional wagers do not have to be of an equal amount. In step 234 the dealer deals two additional community cards 510 face up on the table. The same card dealing and wagering options described in the previous discussion of Hold'Em Poker (FIG. 2), can also be applied to Omaha Poker.

In step 236 the players each form five-card hands from exactly two cards from their four-card hands and three of the community cards 508 and 510. In step 238 all players who placed an additional wager(s) compare their five-card hands, and the player having the best five-card high hand splits all the antes and all the additional wagers with the player having the best five-card low hand. In a preferred embodiment, if the best five-card low hand is nine or more, all of the antes and all of the additional wagers are won by the best five-card high hand. This concludes play of the conventional portion of the game.

In step 240 an action player is determined by lot, usually by rolling dice. An action player marker or button 512 may be placed in front of the selected player. In the shown example player number 2 is the action player. Please note that the players hands 506 shown in FIG. 3 are for the two-card game of Hold'Em Poker not the four-card game of Omaha Poker. In step 242 the action player and a first sequential player compare hands. In a preferred embodiment the first sequential player is the first clockwise player, or player number 3. In step 244 the player having the better hand becomes the Winner and takes the first wager 500 of the other player. In a preferred embodiment, if the hands of the action player and the first sequential player are equal, no first wager 500 is taken and the action player becomes the Winner and continues play with the next sequential player (e.g. player number 4). It is noted that the better hand may be the higher hand or the lower hand according to the chosen rules of play.

In step 246 the Winner in step 244 then compares hands with the next sequential player, player number 4. In step 248 the player having the better hand becomes the Winner and takes the first wager 500 of the other player. In a preferred embodiment, if the hands of the Winner and the next sequential player are equal, no first wager 500 is taken and the Winner continues play with the next sequential player (e.g. player number 5). It is noted that for each comparison the title of Winner passes to player having the better hand. In step 250, it is determined if there are more sequential players. If YES, steps 246 and 248 are repeated until all players have participated. If NO, in step 252 the hand is ended.

The preferred embodiments of the invention described herein are exemplary and numerous modifications, procedural variations, rearrangements, and adjustments can be readily envisioned to achieve an equivalent result, all of which are intended to be embraced within the scope of the appended claims.

We claim:

1. A method of playing a game of poker, comprising the steps of:

each player placing a first wager of the same amount;

dealing a hand to each player;

playing the game of poker wherein each player may make additional wagers, raise additional wagers, or fold in accordance with rules of play;

an initial player and a first sequential player comparing hands;

the player having a better hand becoming a Winner and taking said first wager of the other player;

the Winner and a next sequential player comparing hands;

the player having the better hand becoming the Winner and taking said first wager of the other player; and, repeating said steps of the Winner and the next sequential player comparing hands and the player having the better hand becoming the Winner and taking said first wager of the other player until all players have participated.

2. The method according to claim 1, wherein in said step of an initial player and a first sequential player comparing hands, if the two hands are equal, no said first wager is taken and the initial player becomes the Winner and continues play with the next sequential player.

3. The method according to claim 1, wherein in said step of the Winner and the next sequential player comparing hands, if the two hands are equal, no said first wager is taken and the Winner continues play with the next sequential player.

4. The method of claim 1, wherein the sequential direction is one of clockwise and counterclockwise.

5. The method according to claim 1, wherein the initial player is determined by rolling dice.

6. A method of playing the game of Hold'Em Poker, comprising the steps of:

each player placing an ante;

each player placing a first wager;

a dealer dealing a two-card hand to each player;

the dealer dealing three community cards;

each player having the option of placing at least one additional wager;

the dealer dealing two additional community cards; and, the players each forming five-card hands from their said two-card hands and said community cards;

all players who placed said additional wager comparing five-card hands, the player having the best five-card hand winning all said antes and all said additional wagers;

determining an action player;

the action player and a first sequential player comparing hands;

the player having a better hand becoming a Winner and taking said first wager of the other player;

the Winner and a next sequential player comparing hands;

the player having the better hand becoming the Winner and taking said first wager of the other player; and, repeating said steps of the Winner and the next sequential player comparing hands and the player having the better hand becoming the Winner and taking said first wager of the other player until all players have participated.

7. The method according to claim 6, wherein said better hand is one of the higher hand and the lower hand.

8. A method of playing the game of Omaha Poker, comprising the steps of:

each player placing an ante;

each player placing a first wager;

a dealer dealing a four-card hand to each player;

the dealer dealing three community cards;

each player having the option of placing a least one additional wager;

the dealer dealing two additional community cards; and, the players each forming five-card hands using exactly two cards from their said four-card hands and three of said community cards;

all players who placed said additional wager comparing five-card hands, the player having the best five-card high hand splitting all said antes and all said additional wagers with the player having the best five-card low hand;

determining an action player;

the action player and a first sequential player comparing hands;

the player having a better hand becoming a Winner and taking said first wager of the other player;

the Winner and a next sequential player comparing hands;

the player having the better hand becoming the Winner and taking said first equal wager of the other player; and, repeating said steps of the Winner and the next sequential player comparing hands and the player having the better hand becoming the Winner and taking said first wager of the other player until all players have participated.

9. The method according to claim 8, wherein said better hand is one of the higher hand and the lower hand.

10. The method according to claim 9, wherein if said best five-card low hand is nine or more, all said antes and all said additional wagers are won by said best five-card high hand.

11. A method of playing a game of poker, comprising the steps of:

each player placing a first wager, said first wagers not of the same amount;

dealing a hand to each player;

playing the game of poker wherein each player may make additional wagers, raise additional wagers, or fold in accordance with rules of play;

an initial player and a first sequential player comparing hands;

the player having a better hand becoming a Winner and taking an amount equal to the lesser said first wager of the two comparing players from the other player;

the Winner and a next sequential player comparing hands;

the player having the better hand becoming the Winner and taking an amount equal to the lesser said first wager of the two comparing players from the other player; and, repeating said steps of the Winner and the next sequential player comparing hands and the player having the better hand becoming the Winner and taking an amount equal to the lesser said first wager of the two comparing players from the other player until all players have participated.

12. The method according to claim 11, wherein in said step of an initial player and a first sequential player comparing hands, if the two hands are equal, no said first wager is taken and the initial player becomes the Winner and continues play with the next sequential player.

13. The method according to claim 11, wherein in said step of the Winner and the next sequential player comparing hands, if the two hands are equal, no said first wager is taken and the Winner continues play with the next sequential player.

14. The method of claim 11, wherein the sequential direction is one of clockwise and counterclockwise.

15. The method according to claim 11, wherein the initial player is determined by rolling dice.

* * * * *